US005203673A

United States Patent [19]

Evans

[11] Patent Number: 5,203,673

[45] Date of Patent: Apr. 20, 1993

[54] TIP CLEARANCE CONTROL APPARATUS FOR A TURBO-MACHINE BLADE

[75] Inventor: David H. Evans, Lake Mary, Fla.

[73] Assignee: Westinghouse Electric Corp., Pittsburgh, Pa.

[21] Appl. No.: 823,532

[22] Filed: Jan. 21, 1992

[51] Int. Cl.[5] ..... F01D 5/20

[52] U.S. Cl. ..... 415/173.2; 415/10; 415/108; 415/126; 415/173.3

[58] Field of Search ..... 415/10, 26, 27, 28, 415/108, 126, 127, 151, 173.1, 173.2, 173.3, 173.6, 174.1, 174.2

[56] References Cited

U.S. PATENT DOCUMENTS

| | | | |
|---|---|---|---|
| 3,227,418 | 1/1966 | West | 415/173.1 |
| 3,520,635 | 7/1970 | Killmann et al. | 415/127 |
| 4,343,592 | 8/1982 | May | 415/173.2 |
| 4,844,688 | 7/1989 | Clough et al. . | |
| 4,987,555 | 1/1991 | Twerdochlib . | |
| 5,035,573 | 7/1991 | Tseng et al. . | |
| 5,056,986 | 10/1991 | Silvestri, Jr. et al. . | |
| 5,056,988 | 10/1991 | Corsmeier et al. | 415/173.2 |

FOREIGN PATENT DOCUMENTS

| | | | |
|---|---|---|---|
| 1291560 | 3/1969 | Fed. Rep. of Germany | 415/173.2 |
| 0243901 | 10/1987 | Japan | 415/173.2 |
| 2063374 | 6/1981 | United Kingdom | 415/173.2 |
| 2108591 | 5/1983 | United Kingdom | 415/127 |

*Primary Examiner*—Edward K. Look
*Assistant Examiner*—Christopher Verdier

[57] ABSTRACT

An apparatus is provided for controlling rotating blade tip clearance in a turbo-machine utilizing conical tipped blades. The apparatus comprises an approximately conical blade ring mounted for axially sliding displacement in the turbo-machine cylinder. The conical blade ring encircles the tips of the rotating blades and forms a blade tip clearance therebetween. The tip clearance is controlled during operation of the turbo-machine by axially displacing the conical blade ring. Piston cylinders, actuated by pressurized fluid extracted from the turbo-machine, are used to displace the blade ring. Springs, adapted to bias the blade ring into a position of increased tip clearance, oppose the piston cylinder so that failure of the piston cylinder will not result in a loss of tip clearance. A blade tip clearance sensor transmits information on the tip clearance to a controller that automatically adjusts the blade ring axial position to continuously maintain the optimum tip clearance by regulating the pressure of the fluid supplied to the piston cylinders.

19 Claims, 3 Drawing Sheets

TIP CLEARANCE CONTROL APPARATUS FOR A TURBO-MACHINE BLADE

BACKGROUND OF THE INVENTION

The current invention relates to turbo-machines, such as steam and gas turbines. More specifically, the invention relates to an apparatus for controlling the clearance at the tips of the blades of such turbo-machines.

Typically, turbo-machines, such as gas and steam turbines, have a centrally disposed rotor that rotates within a stationary cylinder. The working fluid flows through one or more rows of circumferentially arranged rotating blades that extend radially outward from the periphery of the rotor shaft. The fluid imparts energy to the shaft that is used to drive a load, such as an electric generator or compressor. In order to ensure that as much energy as possible is extracted from the fluid, the radially outboard tips of the blades are closely encircled by a stationary ring, sometimes referred to as a "blade ring." From the standpoint of thermodynamic efficiency, it is desirable that the clearance between the blade tips and the stationary blade ring, typically referred to as the "tip clearance," be maintained at a minimum so as to prevent fluid from bypassing the row of blades.

Unfortunately, differential thermal expansion between the stationary cylinder and the rotor results in variations in the tip clearance with operating conditions. The specific effect of various operating conditions on tip clearance depends on the type of turbo-machine and its particular design—for example, tip clearances in gas turbine compressors often reach their minimum values during shutdown, whereas the tip clearances in low pressure steam turbines often reach their minimum values at steady state full load operation. Consequently, if insufficient tip clearance is provided at assembly, impact between the blade tips and the blade ring may occur when certain operating conditions are reached. Such impact can cause damage to the blades and is, therefore, to be avoided. Accordingly, a larger than desired tip clearance must be provided to ensure that there is adequate tip clearance to prevent the blade tip from contacting the stationary blade ring under all operating conditions.

Some turbo-machines employ conical tipped blades—that is, blades in which the tip lies in a plane that forms an acute angle with the center line of the rotor. In such cases the stationary blade ring also has a conical surface. Such conical tipped blades provide a number of advantages over cylindrical tipped blades, such as improved thermodynamic performance and simplified manufacture. However, the problem of controlling tip clearance is exacerbated in rotors using conical tipped blades. This is so because axial differential thermal expansion between the rotor and the cylinder during operation, as well as radial differential expansion, can result in a loss of tip clearance if the blade has a conical tip. As a result, much larger tip clearance variations are encountered in conical tipped blades. This situation is compounded in especially long rotors, such as those used in quadruple and sextuple flow low pressure steam turbines, since they have a long span over which axial expansion can build up.

One approach suggested for controlling tip clearance involves mounting the blade ring for radial movement in the stationary cylinder and using various mechanical mechanisms, such as screw threads or rings having inclined slots, to radially displace the blade ring as required to maintain tip clearance—see, for example U.S. Pat. No. 5,035,573 (Tseng et al.). However, this approach suffers from a variety of drawbacks. First, the mechanical mechanisms for displacing the blade rings are quite complicated and prone to sticking and other mechanical malfunctions. Second, such mechanical mechanisms are not adapted for rapid response so that contact between the blade tip and blade ring due to a sudden loss of tip clearance can occur if the operating conditions change rapidly—for example, due to an increase in condenser pressure or an overspeed condition or because the turbo-machine is suddenly tripped for safety reasons. Third, such mechanical mechanisms are not suited for the carefully controlled actuation necessary to continually fine tune the tip clearance during operation.

Another approach, disclosed in U.S. Pat. No. 4,844,688 (Clough et al.), utilizes a blade ring mounted for radial movement as discussed above, but employs air pressure to radially displace the blade ring by causing the pressurized air to deflect a flexible diaphragm that supports the blade ring. However, the amount of tip clearance adjustment that can be obtained by such elastic radial deflection is limited.

Accordingly, it would be desirable to provide an apparatus for controlling the tip clearance of a conical tipped blade that (i) provided for axial, as well as radial, displacement of the blade ring, (ii) allowed tip clearance to be continually and, if necessary, rapidly adjusted and (iii) was capable of displacing the blade ring by a large amount.

SUMMARY OF THE INVENTION

It is an object of the current invention to provide an apparatus for controlling tip clearance between the rotating blades and the stationary blade ring in a turbo-machine that is adapted to control the tip clearance of conical tipped blade and to provide for axial, as well as radial, displacement of the blade ring.

This object is accomplished in a turbo-machine having (i) a centrally disposed rotor having a row of rotating blades extending radially therefrom, each of said blades having an approximately conical tip portion, (ii) a stationary cylinder enclosing said rotor, an approximately conical blade ring mounted for axially sliding displacement in said cylinder, said conical blade ring encircling said blade tips and forming a blade tip clearance therebetween; and (iii) means for controlling said tip clearance during operation of said turbo-machine by axially displacing said conical blade ring. The means for controlling tip clearance may comprise a piston cylinder actuated by pressurized air or steam. In one embodiment, a spring, adapted to bias the blade ring into a position of increased tip clearance, opposes the piston cylinder so that failure of the piston cylinder will not result in a loss of tip clearance.

DESCRIPTION OF THE PREFERRED EMBODIMENT

Figure 1:
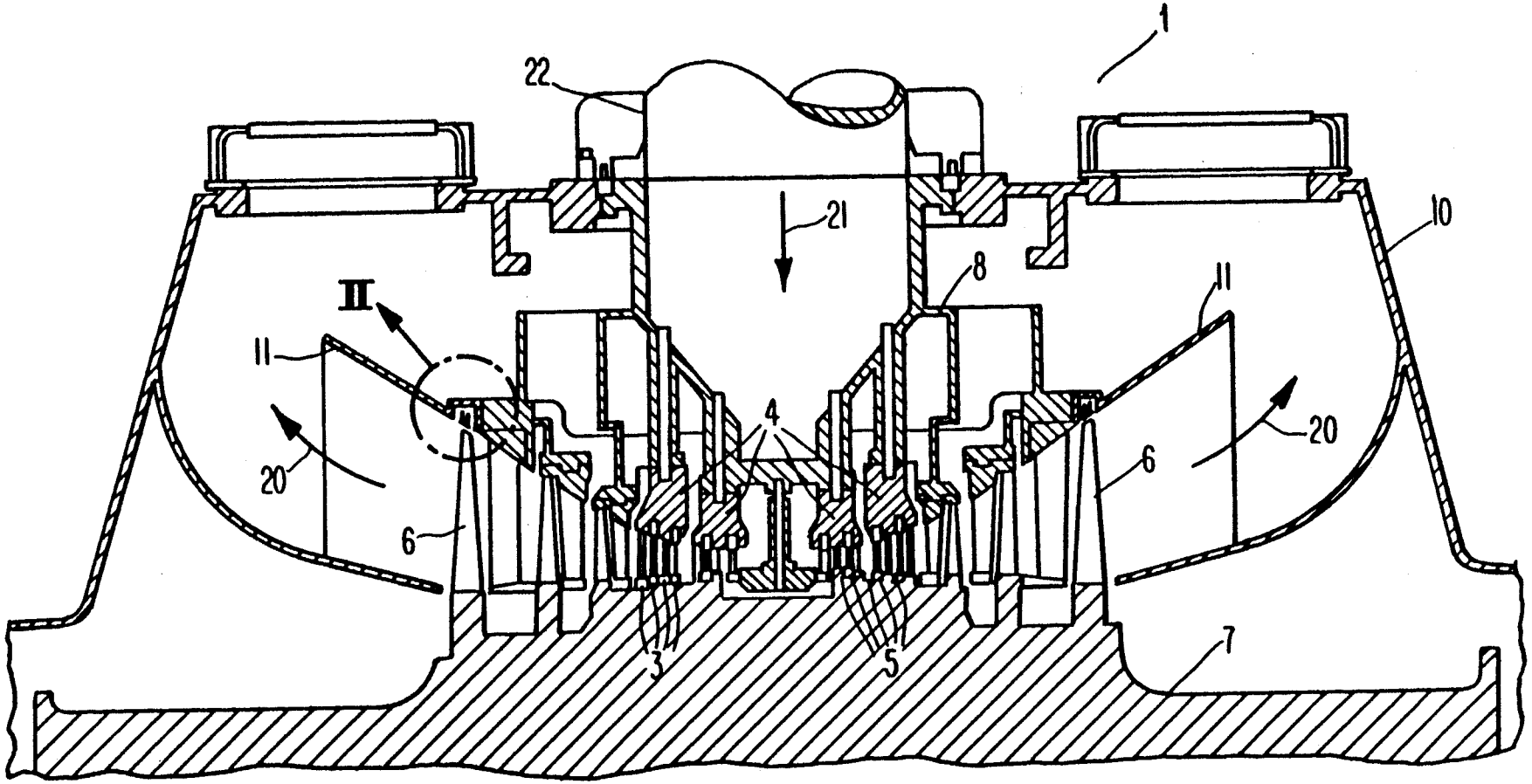
FIG. 1 is a longitudinal cross-section through a low pressure steam turbine incorporating the tip clearance control apparatus according to the current invention in the last row of blades.

There is shown in FIG. 1 a longitudinal crosssection of a double flow low pressure steam turbine 1. The primary components of the steam turbine are an outer cylinder 10, an inner cylinder 8 enclosed by the outer cylinder 10, and a centrally disposed rotor 7 enclosed by the inner cylinder. The inner cylinder 8 and rotor 7 form an annular steam flow path therebetween, the inner cylinder forming the outer periphery of the flow path. Blade rings 4 are attached to the inside surface of the inner cylinder 8. A plurality of circumferentially arrayed stationary vanes 5 and rotating blades 3 are arranged in alternating rows and extend into the steam flow path. The vanes 5 are affixed to the blade rings 4. The blades 3 are affixed to the periphery of the rotor 7 and are encircled by the blade rings 4. An approximately cone-shaped exhaust flow guide 11 is disposed at each end of the inner cylinder 8 and form the blade rings for the last rows of rotating blades 6. The exhaust flow guides have upper and lower halves joined at a horizontal joint.

Steam 21 enters the steam turbine 1 through an inlet 22 formed at the top of the outer cylinder 10. The steam is split into two streams, each flowing axially outward from the center of the steam turbine through the aforementioned steam flow path, thereby imparting energy to the blades 3. The exhaust flow guide 11 guides the steam 20 exiting the inner cylinder 8 to an outlet, not shown, in the outer cylinder 10.

Figure 2:
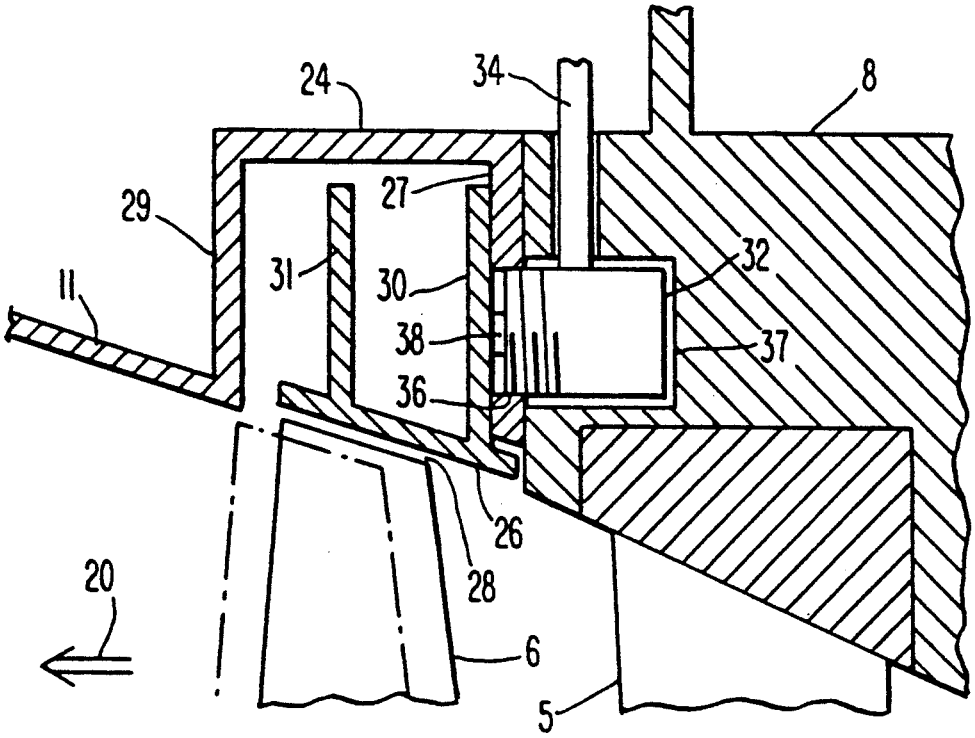
FIG. 2 is a detailed view of the portion of the steam turbine shown in FIG. 1 enclosed by the circle marked II, showing a last row blade and its blade ring in their upstream positions.

As shown in FIG. 2, the last row blade 6 has a conical tip portion. In addition, the inside surface of the exhaust flow guide 11 also has a conical shape. According to the current invention, a blade ring housing 24 is formed at the forward end of the exhaust flow guide 11. A stationary conical blade ring 26 encircles the tips of the blades 6 and is mounted within the blade ring housing 24. (As used herein the term stationary means that, unlike the blades 6, the blade ring 26 does not rotate. However, as explained further below the blade ring 26 is capable of motion in the axial direction.) In the preferred embodiment, the blade ring 26 is comprised of two 180° segments that together form a 360° extending ring. Front and rear radial ribs 30 and 31, respectively, extend outward from the blade ring 24. (As used herein the terms "front" and "rear" refer to upstream and downstream orientations, respectively.) A tip clearance 28 is formed between the tip of the blade 6 and the blade ring 26. As previously discussed, this tip clearance 28 should be kept to a minimum in order to maximize the thermodynamic performance of the row of blades 6.

Figure 4:
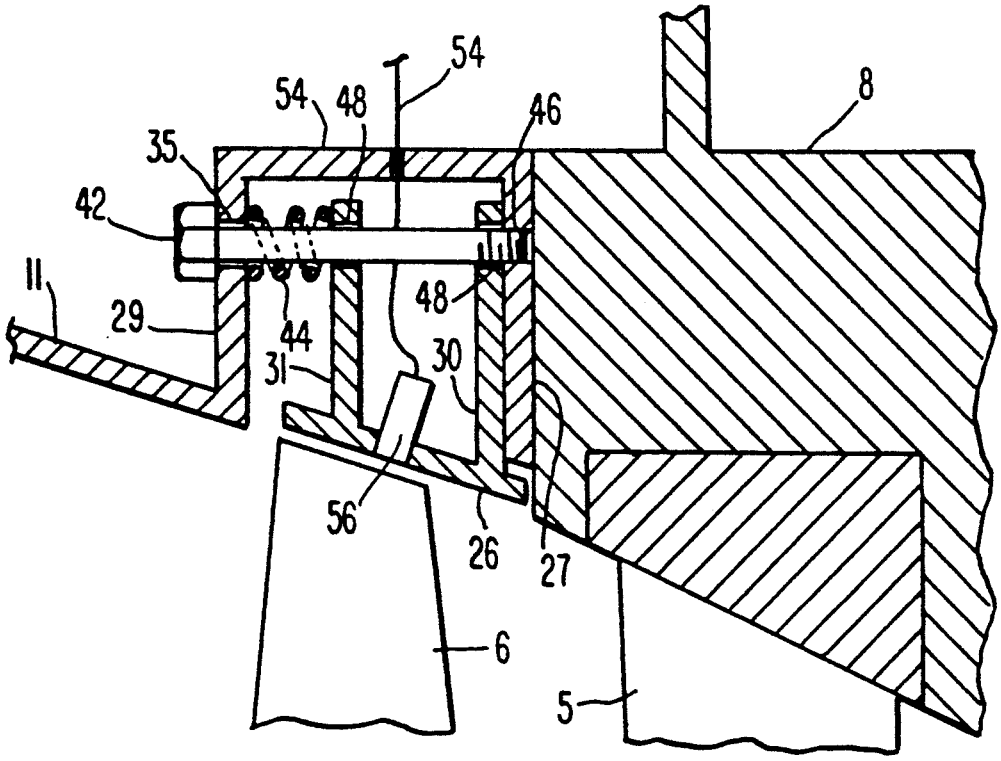
FIG. 4 is a view similar to FIG. 2, showing the blade ring sliding mounting arrangement.

As shown in FIG. 4, the blade ring 26 is slidingly mounted in the housing 24. Specifically, a number of axially oriented guide bolts 42 are circumferentially arranged around the housing 24. The 42 guide bolts extend through holes 35 in the rear wall 29 of the housing 24 and through holes 48 in front and rear ribs 30 and 31, thereby allowing the blade ring to slide axially on the guide bolts. The guide bolts 42 are threaded into tapped holes 46 in the front flange 27 of the exhaust flow guide 11.

Figure 3:
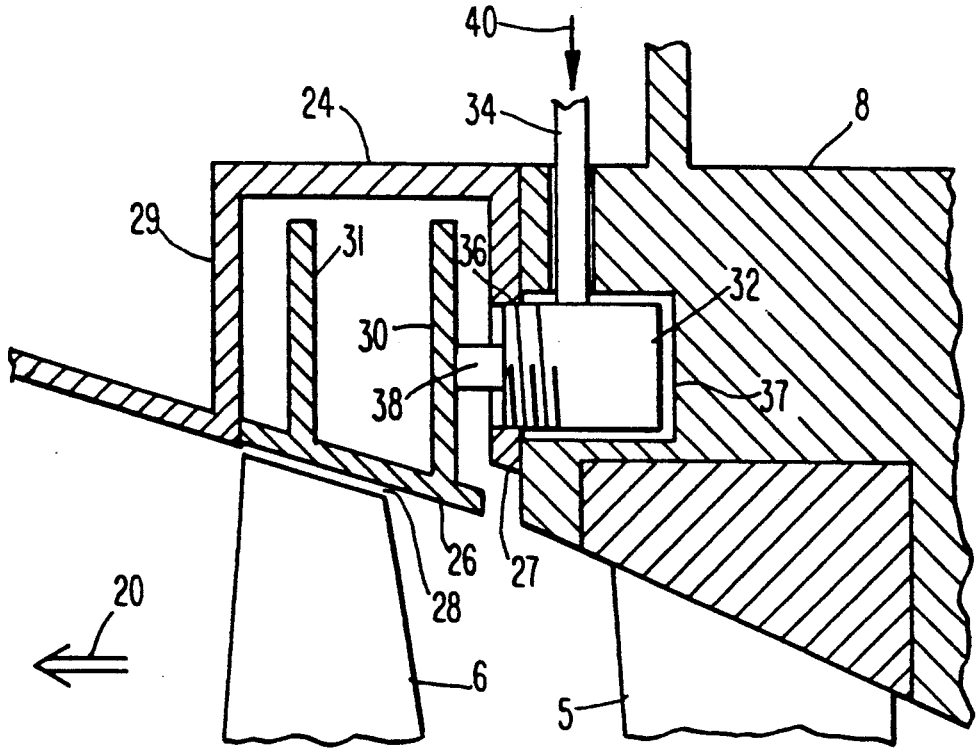
FIG. 3 is a view similar to FIG. 2, showing the blade and blade ring in their downstream positions.

As shown in FIG. 4, in the preferred embodiment, a helical compression spring 44 is disposed around each guide bolt 44 between the rear wall 29 of the housing 24 and the rear rib 31. The springs bias the blade ring 26 upstream so that, when the springs are unopposed, the front rib 30 rests against the front flange 27 of the exhaust flow guide 11, as shown in FIGS. 3 and 4.

As shown in FIG. 2, piston cylinders 32 are threaded into tapped holes 36 in the exhaust flow guide front flange 27 and disposed within recesses 37 machined in the inner cylinder 8. In the preferred embodiment, at least three cylinders 32 are circumferentially spaced around the housing 24. A supply pipe 34 supplies the cylinders 32 with a pressurized fluid 40, which may be air, steam or hydraulic oil. The pistons 38 of the cylinders 32 bear against the front rib 30 of the blade ring 26 so that when the piston cylinders are actuated by supplying pressurized fluid 40 thereto, the pistons 38 oppose the springs 44 and drive the blade ring 26 downstream, as shown in FIG. 3.

As previously discussed, differential thermal expansion between the rotor 7 and the inner cylinder 8 causes the blades 6 and exhaust flow guide 11 to move relative to each other in both the radial and axial directions. In FIG. 2 the solid lines show the position of the blades 6 as they would appear in the cold condition—that is, when the turbine is shut down. Upon startup, and after steady state conditions have been reached, the differential thermal expansion will cause the blades to move downstream relative to the flow guide 11, as depicted by the dashed lines in FIG. 2, thereby increasing tip clearance. If the blade ring 26 were not displaced within the housing 24, this increase in tip clearance 28 would cause a decrease in the thermodynamic performance of the turbine. However, according to the current invention, during operation, pressurized fluid 40 is supplied to the piston cylinders 32 so that the pistons 38 drive the blade ring 26 downstream against the force of the springs 44 to the position shown in FIG. 3. As a result, the tip clearance 28 is decreased to a level that will yield optimum performance.

As shown in FIG. 4, a sensor 56, which may be of the eddy current type, adapted to detect blade tip clearance 28 may be mounted in the blade ring 26. A conductor 54 transmits the output from the sensor 56 to a processor that interprets the output signals as tip clearance. One such tip clearance system is disclosed in U.S. Pat. No. 4,987,555 (Twerdochlib), herein incorporated by reference in its entirety. The use of opposed piston cylinders 32 and biasing springs 44 according to the current invention facilitates accurate control of tip clearance 28. Thus, based on the tip clearance sensed, the amplitude of the pressure supplied to the piston cylinders 32 can be regulated so that the piston force only partially offsets the force of the springs 44. Such regulation would place the blade ring 26 in an intermediate position between the two extremes shown in FIGS. 2 and 3, thereby allowing the tip clearance to be finely tuned. In addition, if a turbine trip or other unusual operating condition caused a rapid decrease in tip clearance, as detected by the sensor, the pressure to the piston cylinders 32 could be rapidly decreased—for example, by dumping fluid—thereby allowing the springs 44 to drive the blade ring 26 upstream and rapidly restore tip clearance.

It should be noted that the springs 44 bias the blade ring 26 into an axial direction—specifically, upstream—that results in increased tip clearance. Thus, the tip clearance control system is fail safe in that a loss of pressure to the pistons cylinders 32 automatically drives the blade ring 26 into a safe axial position free of tip rubs.

In some turbo-machines, such as gas turbine compressors, the temperature of the working fluid in certain portions of the flow path is directly related to the pressure of the fluid. Moreover, since differential thermal expansion is often greatest when the temperature of the working fluid is hottest, the tip clearance in such turbo-machines is often inversely proportional to the fluid temperature. Thus, to prevent tip rubs, the blade ring should move into a position that affords increased tip clearance as the fluid temperature rises. In such cases, the pressurized fluid 40 for actuating the piston cylinders 32 can be strategically extracted from a portion of the turbo-machine in which the working fluid exhibits the appropriate temperature-pressure relationship. In this way, the blade ring 26 position automatically responds to changes in temperature, via the associated change in pressure, by moving into a position required by such higher temperature to maintain adequate tip clearance.

Figure 5:
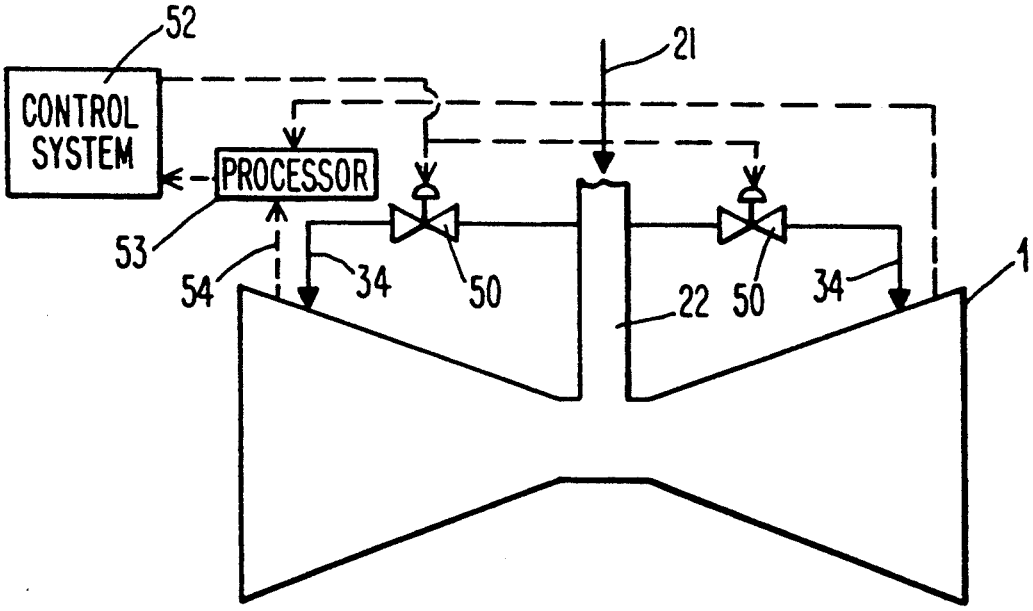
FIG. 5 is schematic diagram of a control system for the tip clearance control apparatus according to the current invention.

FIG. 5 shows a system for automatically controlling tip clearance during operation of the steam turbine 1 using an electronic controller 52. The conductors 54 from the tip clearance sensors 56, shown in FIG. 4, transmit signals to a processor 53 that interprets the signals from the sensor as tip clearance, as previously discussed. The processor 53 transmits this tip clearance information to the turbine controller 52 where this information is compared to optimum tip clearance values stored therein. The pressurized fluid 40 for actuating the piston cylinders 32 is obtained by extracting incoming steam 21 from the steam turbine inlet 22. The controller 52 operates a pressure regulating valve 50 in the pipe 34 supplying steam to the piston cylinders 32, thereby regulating the pressure to the piston cylinders 32. In this manner, the controller 52 controls the force exerted by the pistons 38 against the biasing springs 44 so as to maintain the optimum tip clearance. Thus, the controller 52 continuously adjusts the pressure to the pistons cylinders so that the optimum tip clearance is maintained during all operating conditions.

Although the current invention has been illustrated by reference to controlling tip clearance in the last row of blades in a steam turbine, the invention is also adapted to control tip clearance in other steam turbine blade rows, as well as other types of rotating machinery, such as gas turbines, compressors, etc. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. A turbo-machine, comprising:

a) a centrally disposed rotor having a row of rotating blades extending radially therefrom, each of said blades having an approximately conical tip portion;

b) a stationary cylinder enclosing said rotor and containing a pressurized working fluid flowing therethrough, an approximately conical blade ring mounted for axially sliding displacement in said cylinder, said conical blade ring encircling said blade tips and forming a blade tip clearance therebetween; and c) means for continuously adjusting said tip clearance during operation of said turbo-machine so as to maintain said tip clearance within a predetermined range, said tip clearance continuous adjusting means including:

(i) first force generating means for generating a force for axially displacing said conical blade ring relative to said cylinder in response to the pressure of said working fluid supplied to said first force generating means, and (ii) means for extracting said pressurized working fluid and supplying said fluid extracted to said first force generating means for operation thereof, whereby said tip clearance automatically responds to changes in said pressure of said working fluid.

2. The turbo-machine according to claim 1, wherein the position of said rotor relative to the position of said stationary cylinder varies as a function of the temperature of said working fluid due to thermal expansion, and wherein said pressure of said working fluid extracted by said extraction means varies with said fluid temperature.

3. The turbo-machine according to claim 1, wherein said first force generating means is a piston cylinder.

4. The turbo-machine according to claim 1, wherein said first force generating means comprises a piston cylinder.

5. The turbo-machine according to claim 4, wherein said turbo-machine is a steam turbine, and wherein said pressurized fluid extracting means comprises means for supplying said piston cylinder with steam extracted from said steam turbine.

6. The turbo-machine according to claim 1, wherein said first force generating means comprises means for axially displacing said conical blade ring relative to said cylinder in a first axial direction, and wherein said tip clearance continuous adjusting means further comprises second force generating means for displacing said conical blade ring relative to said blade tip in a second axial direction, opposite to said first axial direction, by exerting a force opposing said force generated by said first force generating means.

7. The turbo-machine according to claim 6, wherein displacement of said conical blade ring in said second axial direction increases said tip clearance, whereby failure of said first force generating means to displace said conical blade ring results in an increase in said tip clearance.

8. The turbo-machine according to claim 7, wherein said first force generating means comprises a piston cylinder and said second force generating means comprises a spring.

9. The turbo-machine according to claim 1, wherein said conical blade ring has an approximately radially extending rib having a plurality of holes formed therein, and further comprising a support member disposed in each of said holes, whereby said rib slides along said support member.

10. The turbo-machine according to claim 1, wherein said tip clearance continuous adjusting means comprises means for sensing the magnitude of said tip clearance.

11. The turbo-machine according to claim 10, wherein said tip clearance sensing means is adapted to generate a signal indicative of said tip clearance sensed, and wherein said tip clearance continuous adjusting means further comprises a controller for automatically adjusting said tip clearance based on said tip clearance sensed.

12. A turbo-machine, comprising:

a) a centrally disposed rotor having a row of rotating blades extending radially therefrom, each of said blades having an approximately conical tip portion;

b) a stationary cylinder enclosing said rotor;

c) a blade ring having an approximately conical surface encircling said blade tips and forming a blade tip clearance therebetween;

d) means for mounting said blade ring in said cylinder so that said blade ring is capable of axial displacement relative to said cylinder, said mounting means including:

(i) an approximately radially extending rib attached to said conical blade ring and having a plurality of holes formed therein, and (ii) a plurality of approximately axially oriented support members attached to said cylinder, a respective one of said support members disposed in each of said holes; and e) means for continuously adjusting said tip clearance by axially displacing said blade ring during operation of said turbo-machine, thereby maintaining said tip clearance within a predetermined range, said tip clearance continuous adjusting means including:

(i) a plurality of springs for generating an axial force biasing said blade ring in a first axial direction, and (ii) a piston cylinder supplied with pressurized fluid for applying an axial force in a second axial direction opposing said springs, whereby said tip clearance is adjusted by balancing said piston cylinder and spring forces.

13. The turbo-machine according to claim 12, wherein axial displacement of said blade ring in said first axial direction increases said blade tip clearance.

14. The turbo-machine according to claim 13, wherein axial displacement of said blade ring in said second axial direction reduces said blade tip clearance.

15. The turbo-machine according to claim 12, wherein:

a) said rib has first and second sides;

b) each of said springs encircles one of said support members and is disposed between said cylinder and said first side of said rib; and c) said piston cylinder is disposed between said cylinder and said second side of said rib.

16. In a steam turbine having (i) a centrally disposed rotor having a row of rotating blades extending radially therefrom, each of said blades having an approximately conical tip portion, (ii) a stationary cylinder enclosing said rotor, and (iii) a blade ring encircling said blade tips and forming a blade tip clearance therebetween, an apparatus for continuously adjusting said tip clearance during operation of said steam turbine so as to maintain said tip clearance as a predetermined value, comprising:

a) a sliding support for said blade ring, whereby said blade ring is capable of displacement relative to said cylinder;

b) means for exerting a force for displacing said blade ring in a first direction during operation of said steam turbine; and b) a piston supplied with steam extracted from said steam turbine for exerting a force for displacing said blade ring in a second direction opposite to said first direction during operation of said steam turbine.

17. The steam turbine according to claim 16, wherein said first direction force exerting means comprises a spring.

18. The steam turbine according to claim 16, wherein said cylinder comprises an exhaust flow guide, said blade ring mounted in said exhaust flow guide.

19. The steam turbine according to claim 16, wherein said blade ring is conical, and wherein said first and second directions are axially oriented.

* * * * *